United States Patent [19]

Kitayama et al.

[11] Patent Number: 4,597,171

[45] Date of Patent: Jul. 1, 1986

[54] TUBE-ENLARGING PRESS FOR USE IN HEAT EXCHANGER FABRICATION

[75] Inventors: Yukio Kitayama, Oyama; Izumi Ochiai, Tochigi; Yoshio Nozawa, Tochigi; Masahiro Miyagi, Tochigi; Tadaaki Ayabe, Ibaraki; Katsuharu Uehara, Tochigi, all of Japan

[73] Assignee: Hitachi, Ltd., Tokyo, Japan

[21] Appl. No.: 641,676

[22] Filed: Aug. 17, 1984

[30] Foreign Application Priority Data

Sep. 9, 1983 [JP] Japan ..... 58-164966

[51] Int. Cl.[4] ..... B23P 15/26; B21D 53/02; B23Q 3/00

[52] U.S. Cl. ..... 29/727; 29/157.3 B; 29/157.3 C; 29/464; 29/559

[58] Field of Search ..... 29/157.3 A, 157.3 B, 29/157.3 C, 157.4, 464, 559, 726, 727

[56] References Cited

U.S. PATENT DOCUMENTS 3,688,533 9/1972 Ames ..... 29/727 X

*Primary Examiner*—Mark Rosenbaum
*Assistant Examiner*—Ronald S. Wallace
*Attorney, Agent, or Firm*—Antonelli, Terry & Wands

[57] ABSTRACT

Disclosed is a tube-enlarging press in which clamping units are provided for preventing the fins and tubes used in a heat exchanger, from being buckled. The clamping units are provided with a through-hole for permitting the passage therethrough of mandrels falling outside of the area of the fin when the mandrels are lowered during the tube enlarging process. Therefore, the arrangements and preparations for replacement of the mandrels can be omitted.

2 Claims, 10 Drawing Figures

TUBE-ENLARGING PRESS FOR USE IN HEAT EXCHANGER FABRICATION

BACKGROUND OF THE INVENTION

1. Field of the Invention

The present invention relates to a tube-enlarging press for fixing the fins and tubes of a cross fin/tube type heat exchanger and, more particularly, to a tube-enlarging press which makes it possible to automatize the arrangements and preparations for jigs involved which are required to be performed in conformity with a change in the specifications of the heat exchangers.

2. Description of the Prior Art

The fixing of the fins and tubes used in a cross fin/-tube type heat exchanger is performed by way of tube enlargement. Since, however, these elemental members are made of thin materials, at the time of tube enlargement the fins and tubes are liable to be buckling or bent. For the purpose of preventing such buckling, it is necessary to support the entire surfaces of those elemental members, for example, by supporting the fins at the outer peripheral portions thereof and the bend portions of the tubes along their bends. For this reason, a tube-enlarging press according to the prior art has drawbacks, for example, in that when the specifications of a heat exchanger involved are changed, a large amount of time is required for making the arrangements and preparations for rearrangement of fin pressing or supporting jigs as well as for replacement of mandrels in conformity with such change.

The above-mentioned drawbacks will now be explained by the use of FIGS. 1A to 1C and FIG. 2. FIG. 1A is a plan view of a cross fin/tube type heat exchanger, FIG. 1B is a side view thereof, and FIG. 1C is a bottom view thereof. Hereinafter, the construction of and a manufacturing method of the heat exchanger will be described with reference to FIGS. 1A to 1C. The heat exchanger is made by a method of piling a large number of fins 1 and side plates 2 in such a manner that each curl height 8 is increased with respect to the thickness 6 of the pile by the amount which corresponds to a proportion of contraction of a tube 3 due to the enlargement thereof, inserting the tubes into the holes 7 of the fins and the similarly formed holes of the side plates in any optional combination of the tube dispositions, fixing the fins 1 and tubes 3 by way of tube enlargement, and fixing the return pipes 9 by brazing, soldering, etc. It should be noted here that, in FIGS. 1A to 1C, the reference numeral 4 denotes a tube bend portion, the reference numeral 5 the length of the fin, the reference numeral 10 the width of the fin, and the reference numeral 11 the tube arrangement or disposition.

FIG. 2 is a view for explaining the construction of a typical example of the tube-enlarging press for use in a cross fin/tube type heat exchanger. A pressurizing means of this tube-enlarging press has a pressurizing cylinder 14 supported by rectangular frame plates 13 and 13*a* fixed to an upper part of a frame 12, said pressurizing cylinder 14 being coupled, by a cylinder rod joint 16, to a main pressurizing plate 17 movable under the guidance of support columns 15. A plurality of rod support plates 19 formed with through holes for preventing mandrels 18 from being buckled or bent, pressurizing plate 20, and a fin pressing plate 21 supporting a fin pressing member 22 thereon are arranged such that the two plates 19 and plate 20 are suspended from the main pressurizing plate 17 by means of connecting rods (not shown) so that the former are movable with respect to the latter and the plate 21.

Receivers 24 for supporting the tube bend portions 4 are constructed such that it is possible to prepare the receivers for any optional tube dispositions 11 by reinserting the positioning pins provided on the receivers appropriate ones of the standard through holes provided in a receiver plate 25 in the form of a cross.

Balance cylinders 27 provided on a base 26 are connected to the fin pressing plate 21 to prevent the same from falling. Further, clamp cams 29 retained on cam holders 28 which are movably supported by the support columns 15 are so arranged as to regulate the position of the fin pressing member 22 at which this member 22 reaches for pressing the fins from above when the enlarging of the tubes is completed.

On the other hand, fin keeping members 23*a*, 23*b*, 23*c* and 23*d* used to keep the four peripheral sides of the fin pile externally are so arranged that they may be rearranged or moved, as required.

However, the above-mentioned prior art tube-enlarging press is designed to be exclusively used for heat exchangers having a fixed size. Therefore, when the area of the fins of a heat exchanger desired to undergo the tube enlargement is changed, a large amount of time is required for newly making the arrangements and preparations for the mandrels 18, fin keeping members 23*a* to 23*d* and receivers 24 in conformity with such change.

SUMMARY OF THE INVENTION

The object of the present invention is to provide a tube-enlarging press for fixing the fins and tubes of a cross fin/tube type heat exchanger, which makes it possible to shorten the time period required to make arrangements and preparations in conformity with a change in the specifications of the heat exchanger and, at the same time, to automatize such arrangements and preparations.

To attain the above object, the present invention has the following features. The arrangements and preparations for a tube-enlarging press made hitherto with respect to a change in the tube disposition, a change in the length and number of fins, and a change in the type or size of tubes are omitted as follows. With respect to a change in the tube disposition, grooves for receiving the bend portions of the tubes are provided in a receiving plate over a region of the plate corresponding to the entire area of the fin of the largest size among those of heat exchangers desired to undergo the tube enlargement, such that each of the grooves extends between adjacent positions which correspond to the positions of adjacent tube-passing through holes arranged in the fins in the form of equilateral triangles, whereby the arrangements and preparations for a change in the tube disposition are omitted.

With respect to a change in the length and number of fins, each clamping unit provided for preventing the fins and tubes from being buckled is provided with through holes for permitting the passage therethrough of mandrels which holes are out of the fin area when these mandrels are lowered for enlarging the tubes, whereby the replacement of the mandrels taking the largest amount of time among the arrangements for the press is omitted.

With respect to a change in the type or size of tubes, a unit of tube-enlarging mandrels having mandrel guides and buckle-preventing plates is provided two or more in number and the mandrel replacement is performed at other portions of a rotary index than that for tube enlargement. By using the above features in combination, it is possible to fix the fins and tubes to each other with the entire arrangements and preparations for a tube enlarging press automized.

DESCRIPTION OF THE PREFERRED EMBODIMENT

Figure 3:
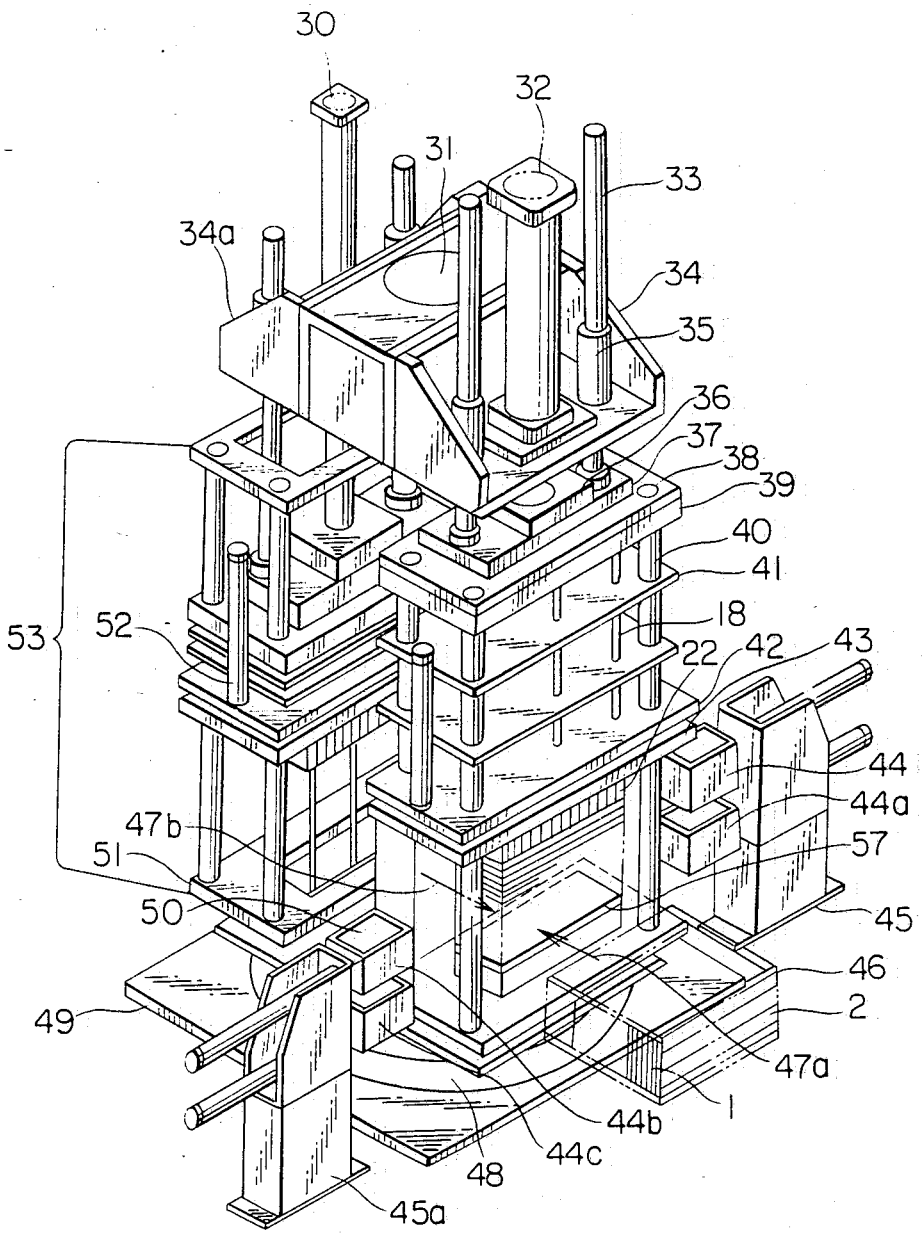
FIG. 3 is a perspective view of a tube-enlarging press according to the present invention.
Figure 4:
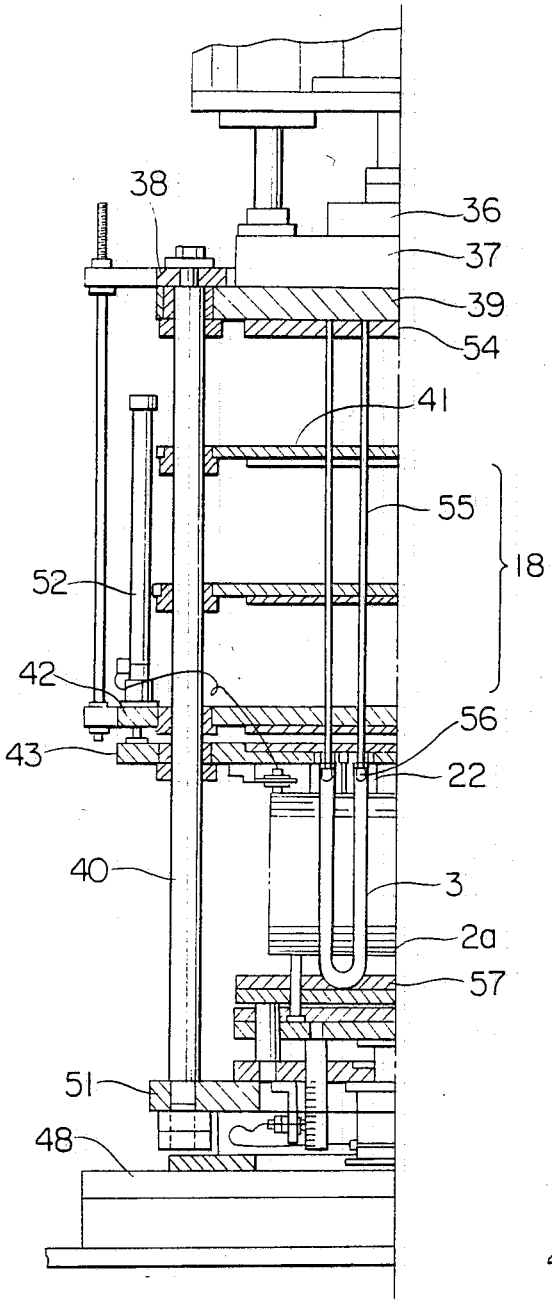
FIGS. 4 and 5 are front sectional views of the tube-enlarging press according to the present invention.
Figure 5:
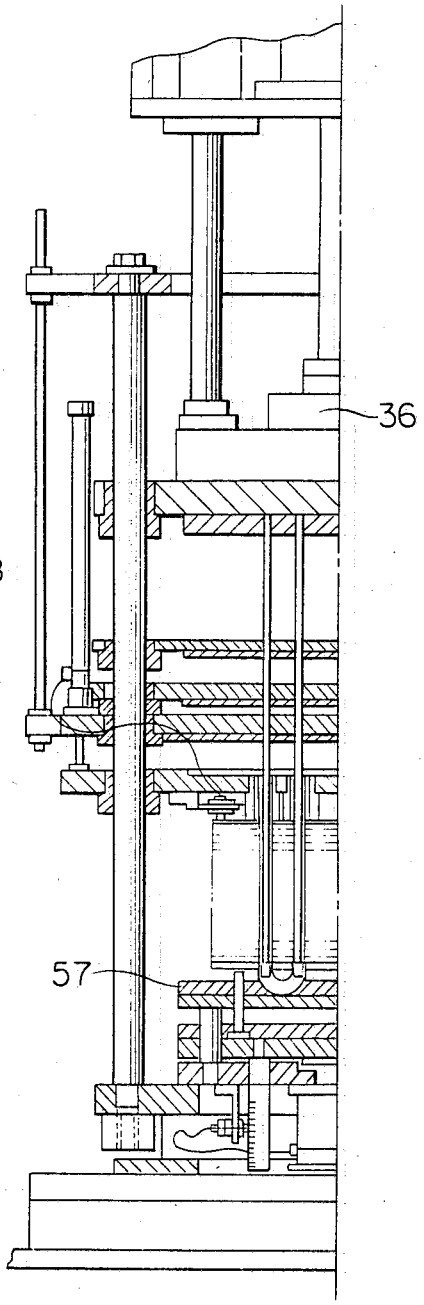

FIGS. 3, 4 and 5 are a perspective view of a tube-enlarging press according to the present invention, a front sectional view showing the press at the time of starting the tube-enlarging operation, and a front sectional view showing the same at the time of completing the tube-enlarging operation, respectively. The tube-enlarging press has a main support column 31 fixed on a base 49, a tube-enlarging pressurizing means 32 and auxiliary driving means 30 which are disposed on frame plates 34 and 34*a* mounted on the upper portion of the main support column 31, respectively. The means 32 and 30 are coupled by rod joints 36 to respective slide rams 37 which are so arranged that they are movable under the guidance of sleeves 35 mounted on the plates 34 and 34*a*, and rods 33 fixed to the slide rams 37 and slidably received by the sleeves 35, respectively. The press is provided with a plurality of tube-enlarging jig units 53 (in this embodiment two units are provided), and each of the means 30 and 32 is connected to and disconnected from one of jig pressurizing plates 39 of the units 53, each plate 39 of which is adapted to be movable by being guided by jig support columns 40 of the unit, by means of a plurality of clamps (not shown) provided on the slide ram 37.

Each of the tube-enlarging jig units 53 comprises a jig support plate 38 which is fixed to the upper end portions of a plurality of the jig support columns 40 mounted on a jig bed 51, a plurality of rod support plates 41, a fixing plate 42, a fin pressing plate 43 supporting a fin pressing member 22 thereon, a plate 54 retained on the jig pressurizing plate 39, and a fin-pressurizing means 52 mounted on the fixing plate 42 which is slidably guided by a group of mandrels 18 each consisting of a mandrel rod 55 and a mandrel head 56 capable of enlarging the tubes of largest size of the heat exchanger desired to be enlarged, as well as to the jig support columns 40. The fin-pressurizing means 52 are adapted to apply pressure to the fin pressing plate 43. A plurality of the tube-enlarging jig units 53 are mounted on a rotary index 48 so that they are capable of being indexed while allowed to rotate about the main support column 31.

With the above-mentioned construction, it is possible to move rotationally the tube-enlarging jig units 53 having the mandrels mounted thereon, whereby the replacing of the mandrels 18 which takes the longest period of time in the arrangements for the press can be performed with high efficiency by the use of the auxiliary driving means 30 at the portions of the rotary index 48 other than the tube-enlarging portion thereof.

Clamping means 45 and 45*a*, each comprising a plurality of first clamping units, are provided on the right and left sides of the tube-enlarging portion of the rotary index 48, respectively, to suppot the ends of the fins in the direction of their lengths 5. More particularly, the means 45 and 45*a* are respectively constituted by clamping units 44–44*a* and clamping units 44*b*–44*c* which are adapted to be driven independently of each other and each of which has a stroke length sufficient for permitting it to support the fins of maximum and minimum lengths 5 desired to undergo the tube enlargement. Each first clamping unit is provided with a through hole 50 for permitting the passage therethrough of the mandrel or mandrels 18 which are out of the fin area when the same are lowered for the purpose of enlarging the tubes 3.

Second clamping units 47*a* and 47*b*, which are arranged in the direction of the width 10 of the fin, are provided in a heat exchanger insertion jig 46 in the same manner as is in the case of the means 45 and 45*a*.

By constituting the clamping units in the above-mentioned manner, no interference occurs between the mandrels 18 which are out of the fin area and the clamping units when the mandrel group is lowered, with the result that the arrangements and preparations for replacement of the mandrels 18 in conformity with a change in the fin area become unnecessary.

Figure 1A:
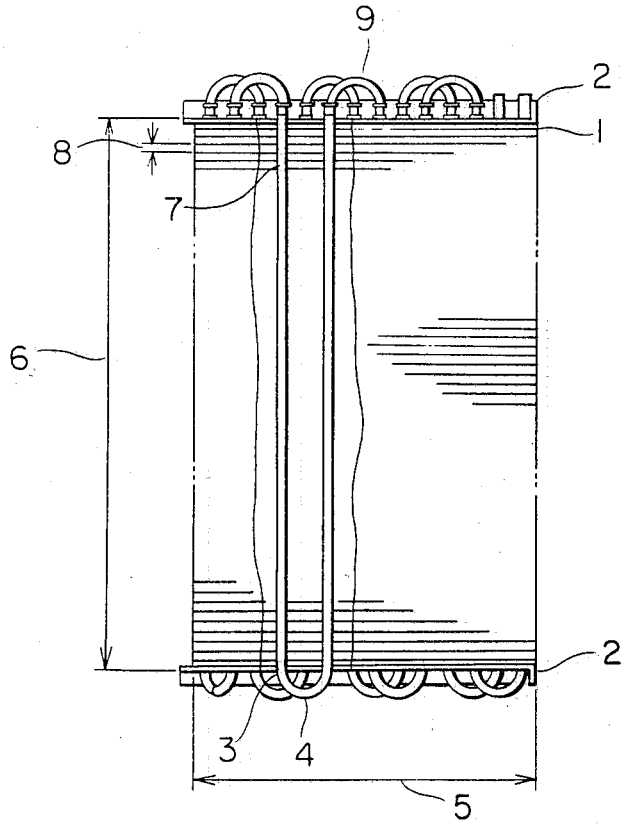
FIG. 1A PRIOR ART
FIGS. 1A to 1C are a plan, side and bottom view for explaining the structure of and a manufacturing method of a cross fin/tube type heat exchanger, respectively.
Figure 1B:
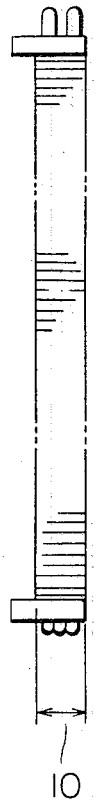
FIG. 1B PRIOR ART
Figure 1C:
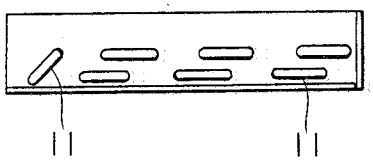
Figure 2:
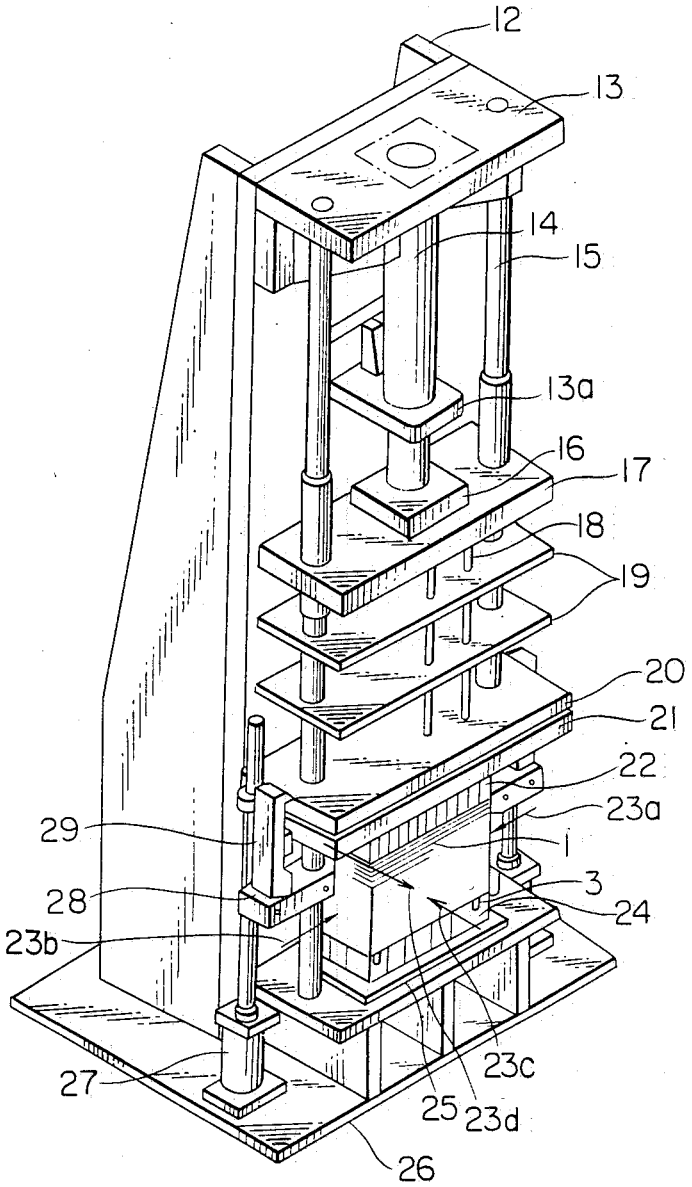
FIG. 2 PRIOR ART
FIG. 2 is a perspective view showing the structure of a typical example of a tube-enlarging press for cross fin/tube type heat exchanger according to the prior art.
Figure 6:
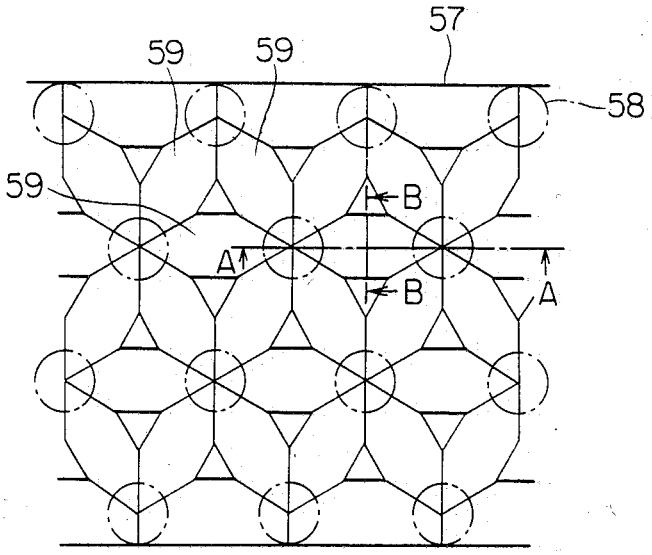
FIG. 6 is a plan view of a tube-receiving plate in accordance with the invention.
Figure 7:
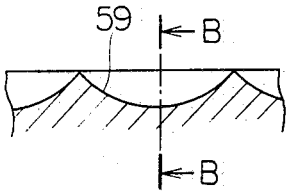
FIG. 7 is a sectional view taken along the line A—A of FIG. 6, showing tube bend receiving grooves.
Figure 8:
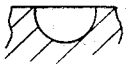
FIG. 8 is a sectional view taken along the line B—B of FIG. 6, showing the tube bend receiving groove in cross section.

FIG. 6 is a plan view of a tube-receiving plate 57, and FIGS. 7 and 8 show the configuration of tube-receiving grooves 59 provided in the tube-receiving plate 57, while FIG. 7 is a sectional view taken along the line A—A of FIG. 6 and FIG. 8 is a sectional view taken along the lines B—B of FIGS. 6 and 7. In FIG. 6, the reference numeral 58 denotes the positions corresponding to the through holes formed in the fin and, in the figure, there is shown a case wherein each position is disposed at each vertex of equilateral triangles. The tube-receiving plate 57 is intended to support the tube bend portions 4 at the time of enlarging the tubes 3. The tube bend portions 4 are supported by the tube-bend receiving grooves 59 formed in the tube-receiving plate 57. The tube bend receiving grooves 59 are provided in the area of the plate 57 corresponding to the entire area of the fin 1 of the heat exchanger. Further, the tube bend receiving grooves 59 are formed in the area surrounding the positions 58 at which the through holes of the fin exist. By providing the tube-bend receiving grooves 59 in the mentioned manner, it is possible to support all of the tube bend portions 4 regardless of the direction in which the tubes are arranged. Thus, the arrangements and preparations for the receivers 24 used in the tube-enlarging press shown in FIG. 2 become unnecessary. It is to be noted here that the size of the tube-receiving plate 57 is made large enough to receive the largest one of a plurality of types of heat exchangers so as to enable the tube enlargement of any one of such heat exchangers.

As stated above, by adopting the present invention, there is provided a tube-enlarging press which enables the arrangements and preparations for tube enlargement to be made in a short time, and which is easy to automatize and wide in applicability. The tube-enlarging press according to the present invention is effective particularly when used in so-called "factory automation", and, from this point of view, the industrial value of the present invention, is very great.

What is claimed is:

1. A tube-enlarging press for fixing fins and tubes incorporated in a cross fin/tube type heat exchanger, which includes first and second clamping units for preventing the fins and tubes from being buckled, the first and second clamping units being arranged in the direction of the length of the fins and in the direction of the width of the fins, respectively, wherein each of said first and second clamping units is provided with a through hole for permitting the passage therethrough of mandrels having fallen outside the area of the fin.

2. A tube-enlarging press for fixing fins and tubes incorporated in a cross fin/tube type heat exchanger, said tube-enlarging press comprising a tube-receiving plate formed with grooves for receiving bend portions of the tubes therein, said grooves being provided in areas between positions corresponding to those of adjacent through holes formed in the fins for receiving the tubes so that said grooves extend from each of said positions in all directions to adjacent positions, and over a region of said plate corresponding to the entire area of the fin of the largest size among those of a plurality of heat exchangers to be processed by said press.

* * * * *